US006119964A

United States Patent [19]

Lombari

[11] Patent Number: 6,119,964

[45] Date of Patent: Sep. 19, 2000

[54] ABRASIVE SUSPENSION JET CUTTING NOZZLE

[76] Inventor: Renato Lombari, 4105 Tomken Road #114, Mississauga, Ontario, Canada, L4W 4E5

[21] Appl. No.: 09/296,310

[22] Filed: Apr. 22, 1999

[51] Int. Cl.[7] ..... F23D 11/10

[52] U.S. Cl. ..... 239/418; 239/596; 239/600; 239/DIG. 8; 451/39; 83/53

[58] Field of Search ..... 239/418, 433, 239/434, 423, 314, 596, 600, DIG. 8; 83/53, 177; 451/39, 40, 90

[56] References Cited

U.S. PATENT DOCUMENTS

| | | | |
|---|---|---|---|
| D. 355,703 | 2/1995 | Duell | 239/418 |
| 2,176,577 | 10/1939 | Tirrell | 83/53 |
| 2,399,680 | 5/1946 | Keefer | 83/53 |
| 4,587,772 | 5/1986 | Griffiths | 239/314 |
| 4,648,215 | 3/1987 | Hashish et al. | 239/596 |
| 5,527,204 | 6/1996 | Rhoades | 451/40 |

*Primary Examiner*—Andres Kashnikow
*Assistant Examiner*—Lisa Ann Douglas

[57] ABSTRACT

An abrasive suspension jet cutting nozzle is provided including an abrasive suspension inlet having a protrusion with an inlet conduit formed therein for receiving an abrasive suspension fluid. Also included is a substantially annular high pressure propellant inlet adapted to receive the abrasive suspension inlet in fixed relationship therewith. The high pressure propellant inlet has an inlet conduit for receiving abrasive suspension fluid. Further provided is an insert positioned within the high pressure propellant inlet with a recess adapted to receive the protrusion of the abrasive suspension inlet. The insert has at least one channel for directing the abrasive suspension fluid between the protrusion of the abrasive suspension inlet and the recess of the insert for combining with the abrasive suspension fluid such that both exit the nozzle.

6 Claims, 3 Drawing Sheets

ABRASIVE SUSPENSION JET CUTTING NOZZLE

BACKGROUND OF THE INVENTION

1. Field of the Invention

The present invention relates to abrasive suspension fluid cutting devices and more particularly pertains to a new abrasive suspension jet cutting nozzle for propelling an abrasive suspension fluid in an effective manner for cutting purposes.

2. Description of the Prior Art

The use of abrasive suspension fluid cutting devices is known in the prior art. More specifically, abrasive suspension fluid cutting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Patent No. 5,527,204; U.S. Pat. No. 4,648,215; U.S. Pat. No. 4,587,772; U.S. Pat. No. 2,399,680; U.S. Pat. No. 2,176,577; and U.S. Patent Des. 355,703.

In these respects, the abrasive suspension jet cutting nozzle according to the present invention substantially departs from the conventional concepts and designs of the prior art, and in so doing provides an apparatus primarily developed for the purpose of propelling an abrasive suspension fluid in an effective manner for cutting purposes.

SUMMARY OF THE INVENTION

In view of the foregoing disadvantages inherent in the known types of abrasive suspension fluid cutting devices now present in the prior art, the present invention provides a new abrasive suspension jet cutting nozzle construction wherein the same can be utilized for propelling an abrasive suspension fluid in an effective manner for cutting purposes.

The general purpose of the present invention, which will be described subsequently in greater detail, is to provide a new abrasive suspension jet cutting nozzle apparatus and method which has many of the advantages of the abrasive suspension fluid cutting devices mentioned heretofore and many novel features that result in a new abrasive suspension jet cutting nozzle which is not anticipated, rendered obvious, suggested, or even implied by any of the prior art abrasive suspension fluid cutting devices, either alone or in any combination thereof.

To attain this, the present invention generally comprises an abrasive suspension inlet having a substantially disk-shaped upper portion with a top face, a bottom face, and a periphery having a pair of diametrically opposed flat spots formed therein. As shown in FIG. 2 & 3, the top face of the upper portion has an inlet port formed of a sleeve coupled thereto and extending therefrom in concentric relationship. Such sleeve is equipped with a top compartment with a plurality of threaded grooves formed therein. Associated therewith is a bottom compartment with a frusto-conical configuration. The abrasive suspension inlet further includes an intermediate portion with a disk-shaped top extent integrally coupled to the bottom face of the upper portion and extending downwardly therefrom in concentric relationship therewith. A plurality of threaded grooves are formed in an outer periphery of the top extent of the intermediate portion. As shown in FIGS. 2 & 3, the top extent of the intermediate portion has a diameter less than that of the upper portion.

The intermediate portion further includes a disk-shaped middle extent integrally coupled to the top extent of the intermediate portion with a smooth outer periphery. The middle extent of the intermediate portion has a diameter and height less than that of the top extent of the intermediate portion of the abrasive suspension inlet. The intermediate portion of the abrasive suspension inlet further includes a disk-shaped bottom extent integrally coupled to the middle extent of the intermediate portion with a smooth outer periphery. Ideally, a diameter and height of the bottom extent are less than that of the middle extent of the intermediate portion of the abrasive suspension inlet. The abrasive suspension inlet further includes a lower portion with a conical configuration coupled to the bottom extent of the intermediate portion of the abrasive suspension inlet. The lower portion of the abrasive suspension inlet extends from the intermediate portion in coaxial relationship therewith. A height of the lower portion is greater than that of the upper portion and the intermediate portion while a diameter of the lower portion is less than that of the bottom extent of the intermediate portion of the abrasive suspension inlet. As shown in FIGS. 2 & 3, a right cylindrical inlet conduit is formed between a bottom end of the lower portion and the compartments of the sleeve for allowing the expulsion of an abrasive suspension fluid therefrom. Next provided is a high pressure high pressure propellant inlet including a solid annular ring with a top end, a bottom end, and a peripheral side wall formed therebetween. Such peripheral side wall is defined by an outer surface, an inner surface, and an interior space. As shown in FIGS. 2 & 3, the outer surface of the high pressure propellant inlet has an inlet port including a bore. This bore is equipped with an outboard compartment having a plurality of threaded grooves formed therein. Associated therewith is an inboard compartment with a frusto-conical configuration in communication with the interior space of the high pressure propellant inlet. The inner surface of the high pressure propellant inlet has an upper extent with a plurality of threaded grooves formed therein for releasably engaging those of the top extent of the intermediate portion of the abrasive suspension inlet. As shown in FIGS. 2 & 3, the inner surface of the high pressure propellant inlet is equipped with a smooth cylindrical middle extent and an inwardly tapering frusto-conical lower extent. Finally, a dispensing insert is included for being inserted within the high pressure propellant inlet with the abrasive suspension inlet mounted thereover. The dispensing insert includes a top face having a recess centrally formed therein. Such recess is equipped with a size and a height equal to that of the bottom extent of the intermediate portion of the abrasive suspension inlet. The top face also has a conical bore formed therein which extends within the dispensing insert and terminates short of a bottom face of the dispensing insert. A right cylindrical outlet conduit is formed between the bottom face and the conical recess. The dispensing insert further has a side wall including an upper part with a disk-shaped configuration having a reduced diameter equal to that of the middle extent of the intermediate portion of the abrasive suspension inlet. Such side wall further has an intermediate part with a disk-shaped configuration having a diameter equal to that of the top extent of the intermediate portion of the high pressure propellant inlet. As such, an annular space is defined which remains in communication with the inlet port of the high pressure propellant inlet. Finally, positioned below the intermediate portion is a lower part with a frusto-conical configuration. As shown in FIGS. 3 & 4, the intermediate part of the side wall of the dispensing insert has a plurality of radially extending channels formed therein.

Such channels reside in communication with the conical bore of the dispensing insert and the inlet port of the high pressure propellant inlet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new abrasive suspension jet cutting nozzle apparatus and method which has many of the advantages of the abrasive suspension fluid cutting devices mentioned heretofore and many novel features that result in a new abrasive suspension jet cutting nozzle which is not anticipated, rendered obvious, suggested, or even implied by any of the prior art abrasive suspension fluid cutting devices, either alone or in any combination thereof.

It is another object of the present invention to provide a new abrasive suspension jet cutting nozzle which may be easily and efficiently manufactured and marketed.

It is a further object of the present invention to provide a new abrasive suspension jet cutting nozzle which is of a durable and reliable construction.

An even further object of the present invention is to provide a new abrasive suspension jet cutting nozzle which is susceptible of a low cost of manufacture with regard to both materials and labor, and which accordingly is then susceptible of low prices of sale to the consuming public, thereby making such abrasive suspension jet cutting nozzle economically available to the buying public.

Still yet another object of the present invention is to provide a new abrasive suspension jet cutting nozzle which provides in the apparatuses and methods of the prior art some of the advantages thereof, while simultaneously overcoming some of the disadvantages normally associated therewith.

Still another object of the present invention is to provide a new abrasive suspension jet cutting nozzle for propelling an abrasive suspension fluid in an effective manner for cutting purposes.

Even still another object of the present invention is to provide a new abrasive suspension jet cutting nozzle that includes an abrasive suspension inlet having a protrusion with an inlet conduit formed therein for receiving an abrasive suspension fluid. Also included is a substantially annular high pressure propellant inlet adapted to receive the abrasive suspension inlet in fixed relationship therewith. The high pressure propellant inlet has an inlet conduit for receiving abrasive suspension fluid. Further provided is an insert positioned within the high pressure propellant inlet with a recess adapted to receive the protrusion of the abrasive suspension inlet. The insert has at least one channel for directing the abrasive suspension fluid between the protrusion of the abrasive suspension inlet and the recess of the insert for combining with the abrasive suspension fluid such that both exit the nozzle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
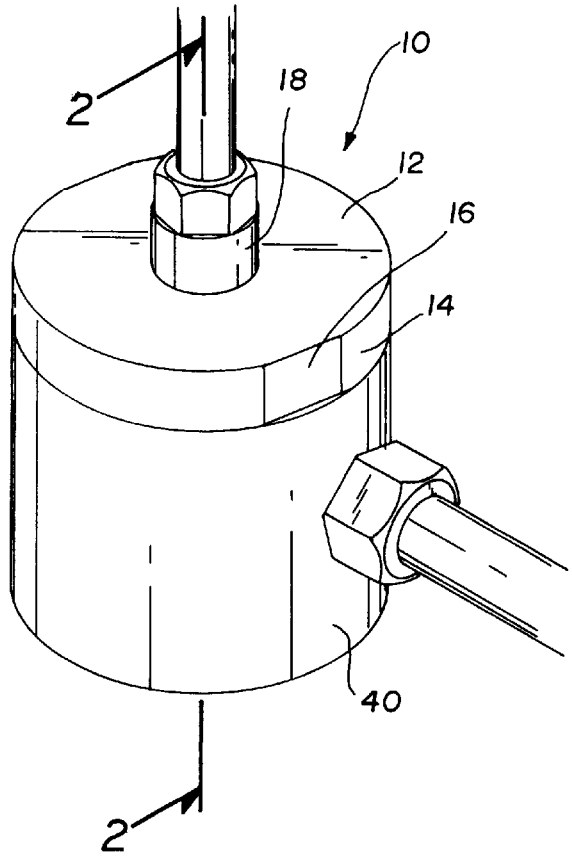
FIG. 1 is a perspective view of a new abrasive suspension jet cutting nozzle according to the present invention.

With reference now to the drawings, and in particular to FIGS. 1 through 5 thereof, a new abrasive suspension jet cutting nozzle embodying the principles and concepts of the present invention and generally designated by the reference numeral 10 will be described.

Figure 2:
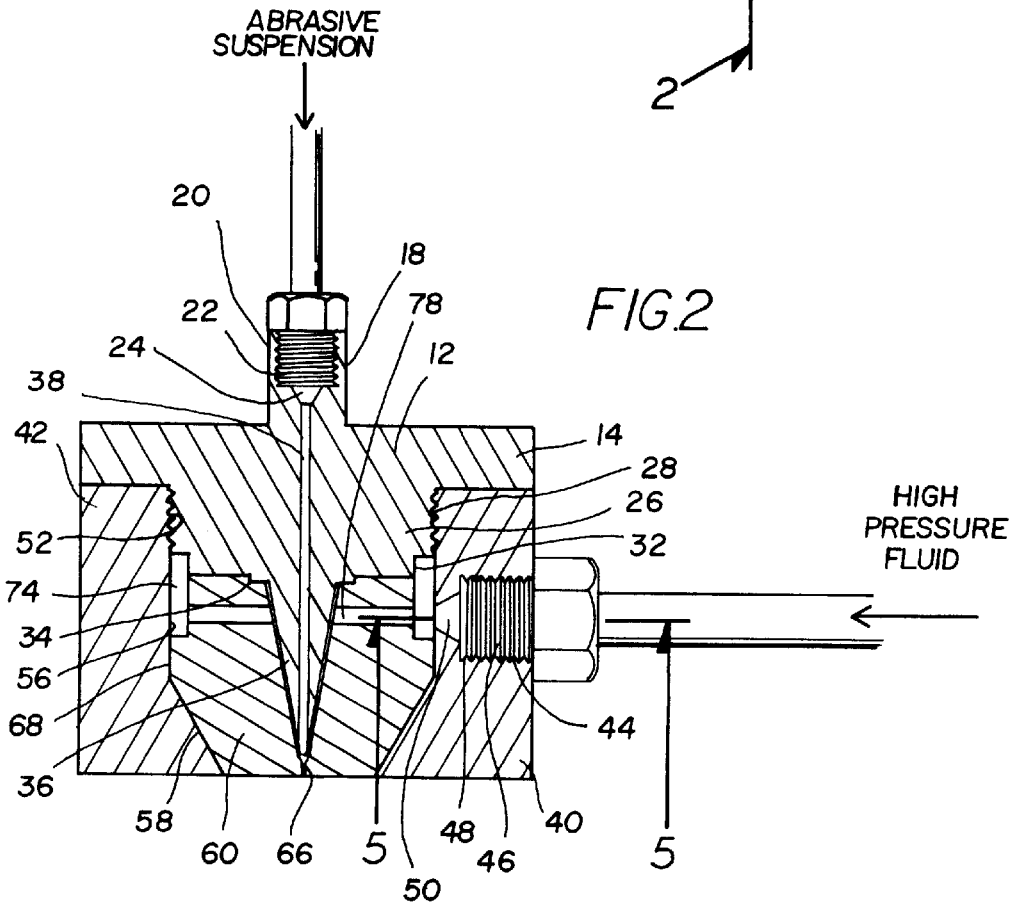
FIG. 2 is a side cross-sectional view of the present invention taken along line 2—2 shown in FIG. 1.
Figure 3:
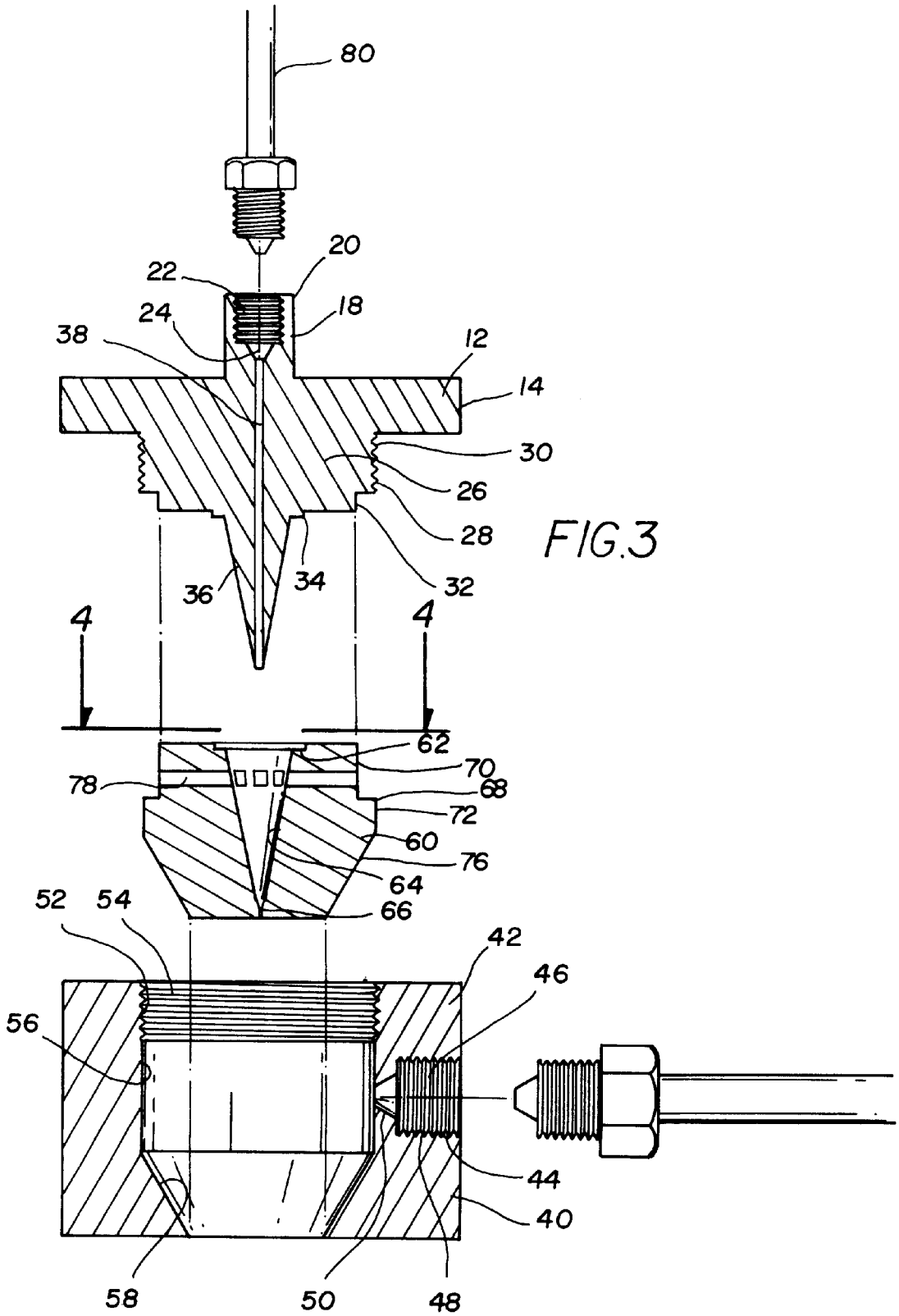
FIG. 3 is an exploded cross-sectional view of the present invention.

The present invention, designated as numeral 10, includes an abrasive suspension inlet 12 having a substantially disk-shaped upper portion 14 with a top face, a bottom face, and a periphery having a pair of diametrically opposed flat spots 16 formed therein. As shown in FIG. 2 & 3, the top face of the upper portion has an inlet port 18 formed of a sleeve 20 coupled thereto and extending therefrom in concentric relationship. Such sleeve is equipped with a top compartment 22 with a plurality of threaded grooves formed therein. Associated therewith is a bottom compartment 24 with a frusto-conical configuration.

The abrasive suspension inlet further includes an intermediate portion 26 with a disk-shaped top extent 28 integrally coupled to the bottom face of the upper portion and extending downwardly therefrom in concentric relationship therewith. A plurality of threaded grooves 30 are formed in an outer periphery of the top extent of the intermediate portion. As shown in FIGS. 2 & 3, the top extent of the intermediate portion has a diameter less than that of the upper portion. The intermediate portion further includes a disk-shaped middle extent 32 integrally coupled to the top extent of the intermediate portion with a smooth outer periphery. The middle extent of the intermediate portion has a diameter and height less than that of the top extent of the intermediate portion of the abrasive suspension inlet. The intermediate portion of the abrasive suspension inlet further includes a disk-shaped bottom extent 34 integrally coupled to the middle extent of the intermediate portion with a smooth outer periphery. Ideally, a diameter and height of the bottom extent are less than that of the middle extent of the intermediate portion of the abrasive suspension inlet.

The abrasive suspension inlet further includes a lower portion 36 with a conical configuration coupled to the bottom extent of the intermediate portion of the abrasive suspension inlet. The lower portion of the abrasive suspension inlet extends from the intermediate portion in coaxial relationship therewith. A height of the lower portion is greater than that of the upper portion and the intermediate portion while a diameter of the lower portion is less than that of the bottom extent of the intermediate portion of the abrasive suspension inlet. As shown in FIGS. 2 & 3, a right cylindrical inlet conduit 38 is formed between a bottom end of the lower portion and the compartments of the sleeve for allowing the expulsion of abrasive suspension fluid therefrom that is received via the inlet port of the abrasive suspension inlet. Ideally, the abrasive suspension fluid takes the form of abrasive particles, SUPER-WATER® and water or the like.

Next provided is a high pressure high pressure propellant inlet 40 including a solid annular ring 42 with a top end, a bottom end, and a peripheral side wall formed therebetween. Such peripheral side wall is defined by an outer surface, an inner surface, and an interior space. As shown in FIGS. 2 & 3, the outer surface of the high pressure propellant inlet has an inlet port 44 including a bore 46. This bore is equipped with an outboard compartment 48 having a plurality of threaded grooves formed therein. Associated therewith is an inboard compartment 50 with a frusto-conical configuration in communication with the interior space of the high pressure propellant inlet.

The inner surface of the high pressure propellant inlet has an upper extent 52 with a plurality of threaded grooves 54 formed therein for releasably engaging those of the top extent of the intermediate portion of the abrasive suspension inlet. As shown in FIGS. 2 & 3, the inner surface of the high pressure propellant inlet is further equipped with a smooth cylindrical middle extent 56 and an inwardly tapering frusto-conical lower extent 58.

Finally, a dispensing insert 60 is included for being inserted within the high pressure propellant inlet with the abrasive suspension inlet mounted thereover. The dispensing insert includes a top face having a recess 62 centrally formed therein. Such recess is equipped with a size and a height equal to that of the bottom extent of the intermediate portion of the abrasive suspension inlet. The top face also has a conical bore 64 formed therein which extends within the dispensing insert and terminates short of a bottom face of the dispensing insert. A right cylindrical outlet conduit 66 is formed between the bottom face and the conical bore of the insert.

The dispensing insert further has a side wall 68 including an upper part 70 with a disk-shaped configuration having a reduced diameter equal to that of the middle extent of the intermediate portion of the abrasive suspension inlet. Such side wall further has an intermediate part 72 with a disk-shaped configuration having a diameter equal to that of the top extent of the intermediate portion of the high pressure propellant inlet. As such, an annular space 74 is defined during use which remains in communication with the inlet port of the high pressure propellant inlet. Finally, positioned below the intermediate portion is a lower part 76 with a frusto-conical configuration.

Figure 4:
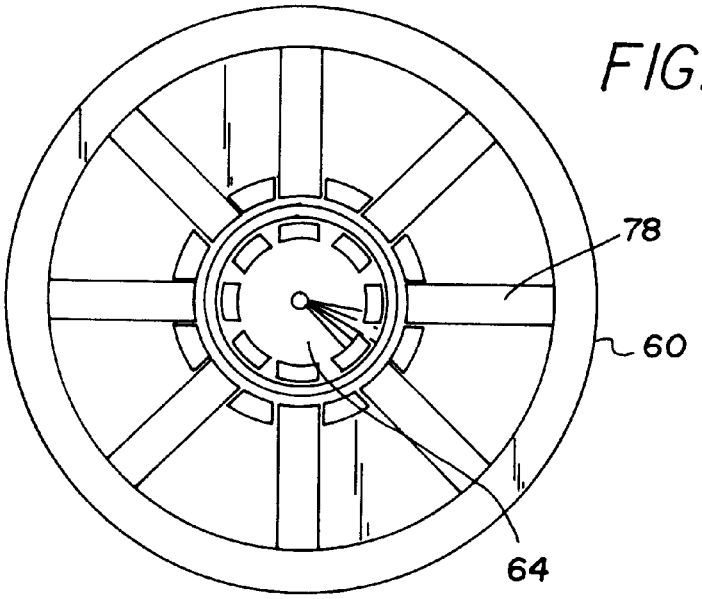
FIG. 4 is a top view of the insert of the present invention.

As shown in FIGS. 3 & 4, the intermediate part of the side wall of the dispensing insert has a plurality of radially extending channels 78 formed therein. Such channels reside in communication with the conical bore of the dispensing insert and the inlet port of the high pressure propellant inlet.

As such, the channels serve for expelling high pressure fluid received via the inlet port of the high pressure propellant insert. Such high pressure fluid is expelled between the conical bore of the dispensing insert and the lower portion of the abrasive suspension inlet. It should be noted that the abrasive suspension inlet has abrasive particles, SUPER-WATER® and water mixed therewith. To this end, the abrasive suspension fluid that is received via the inlet port of the abrasive suspension inlet combines, via venturi action, with the high pressure fluid and both exit the outlet conduit of the dispensing insert.

Figure 5:
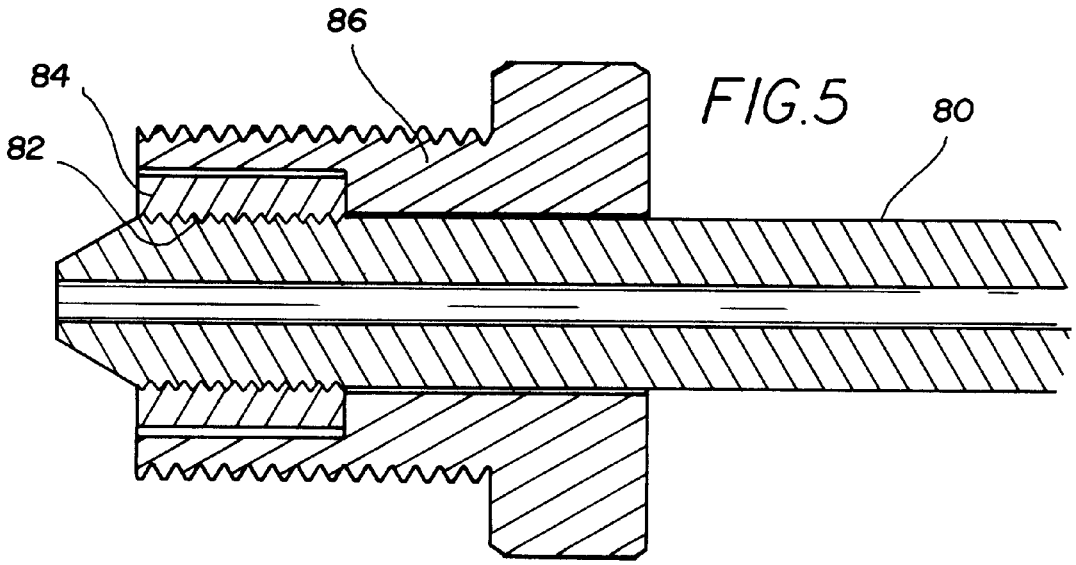
FIG. 5 is a side cross-sectional view of the present invention taken along line 5—5 shown in FIG. 2.

As shown in FIG. 5, each of the inlet ports are connected to an inlet tube 80 having a frusto-conical end and a plurality of threaded grooves 82 formed therein. Each of the inlet tubes further has a threaded collar 84 screwably mounted thereon. Finally, a retaining nut 86 is included with an inboard end rotatably mounted to the collar and threadedly engaged with the associated inlet port. An outboard end of the retaining nut is enlarged for facilitated gripping.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An abrasive suspension jet cutting nozzle comprising, in combination:

an abrasive suspension inlet including a substantially disk-shaped upper portion with a top face, a bottom face, and a periphery having a pair of diametrically opposed flat spots formed therein, the top face of the upper portion having an inlet port formed of a sleeve coupled thereto and extending therefrom in concentric relationship with a top compartment with a plurality of threaded grooves formed therein and a bottom compartment with a frusto-conical configuration, the abrasive suspension inlet further including an intermediate portion with a disk-shaped top extent integrally coupled to the bottom face of the upper portion and extending downwardly therefrom in concentric relationship therewith and having a plurality of threaded grooves formed in an outer periphery thereof and a diameter less than that of the upper portion, the intermediate portion further including a disk-shaped middle extent integrally coupled to the top extent of the intermediate portion with a smooth outer periphery and a diameter and height less than that of the top extent of the intermediate portion of the abrasive suspension inlet, the intermediate portion of the abrasive suspension inlet further including a disk-shaped bottom extent integrally coupled to the middle extent of the intermediate portion with a smooth outer periphery and a diameter and height less than that of the middle extent of the intermediate portion of the abrasive suspension inlet, the abrasive suspension inlet further including a lower portion with a conical configuration coupled to the bottom extent of the intermediate portion of the abrasive suspension inlet and extending therefrom in coaxial relationship therewith with a height greater than that of the upper portion and the intermediate portion and a diameter less than that of the bottom extent of the intermediate portion of the abrasive suspension inlet, wherein a right cylindrical inlet conduit is formed between a bottom end of the lower portion and the compartments of the sleeve for allowing the expulsion of abrasive suspension fluid therefrom;

a high pressure propellant inlet including a solid annular ring with a top end, a bottom end, and a peripheral side wall formed therebetween defined by an outer surface, an inner surface, and an interior space, the outer surface of the high pressure propellant inlet having an inlet port including a bore having an outboard compartment with a plurality of threaded grooves formed therein and an inboard compartment with a frusto-conical configuration in communication with the interior space of the high pressure propellant inlet, the inner surface of the high pressure propellant inlet having an upper extent with a plurality of threaded grooves formed therein for releasably engaging those of the top extent of the intermediate portion of the abrasive suspension inlet, a smooth cylindrical middle extent, and an inwardly tapering frusto-conical lower extent; and a dispensing insert adapted for being inserted within the high pressure propellant inlet with the abrasive suspension inlet mounted thereover, the dispensing insert including a top face having a recess centrally formed therein with a size and a height equal to that of the bottom extent of the intermediate portion of the abrasive suspension inlet and a conical bore formed in the top face and extending within the dispensing insert and terminating short of a bottom face of the dispensing insert whereat a right cylindrical outlet conduit is formed between the bottom face and the conical recess, the dispensing insert further having a side wall including an upper part with a disk-shaped configuration having a reduced diameter equal to that of the middle extent of the intermediate portion of the abrasive suspension inlet, an intermediate part with a disk-shaped configuration having a diameter equal to that of the top extent of the intermediate portion of the high pressure propellant inlet for defining an annular space in communication with the inlet port of the high pressure propellant inlet, and a lower part with a frusto-conical configuration;

wherein the intermediate part of the side wall of the dispensing insert has a plurality of radially extending channels formed therein and in communication with the conical bore of the dispensing insert and the inlet port of the high pressure propellant inlet for expelling abrasive suspension fluid received via the inlet port of the propellant insert between the conical bore of the dispensing insert and the lower portion of the abrasive suspension inlet for propelling the abrasive suspension fluid received via the inlet port of the abrasive suspension inlet out the outlet conduit of the dispensing insert.

2. An abrasive suspension jet cutting nozzle comprising:

an abrasive suspension inlet including a protrusion with an inlet conduit formed therein for receiving an abrasive suspension fluid;

a substantially annular high pressure propellant inlet adapted to receive the abrasive suspension inlet in fixed relationship therewith, the high pressure propellant inlet having an inlet conduit for receiving abrasive suspension fluid; and an insert positioned within the high pressure propellant inlet with a recess adapted to receive the protrusion of the abrasive suspension inlet, the insert having at least one channel for directing the abrasive suspension fluid between the protrusion of the abrasive suspension inlet and the recess of the insert for combining with the abrasive suspension fluid such that both exit the nozzle.

3. An abrasive suspension jet cutting nozzle as set forth in claim 2 wherein the abrasive suspension inlet and the high pressure propellant inlet are screwably coupled.

4. An abrasive suspension jet cutting nozzle as set forth in claim 2 wherein a plurality of radially extending channels are formed in the insert and an annular space is positioned between the insert and the high pressure propellant inlet for allowing the direction of the abrasive suspension fluid between the protrusion of the abrasive suspension inlet and the recess of the insert.

5. An abrasive suspension jet cutting nozzle as set forth in claim 2 wherein a substantially right cylindrical conduit is formed in the insert between the recess and a bottom face of the insert.

6. An abrasive suspension jet cutting nozzle as set forth in claim 2 wherein the recess of the insert and the protrusion of the abrasive suspension inlet are substantially conical in shape.

* * * * *